United States Patent [19]
Audenard
[11] 4,445,206
[45] Apr. 24, 1984

[54] REMOTE ACOUSTIC MONITORING DEVICE WHICH IS TESTABLE BY VARIATION OF THE SUPPLY VOLTAGE

[75] Inventor: Bernard Audenard, Paris, France
[73] Assignee: CGR, Paris, France

[21] Appl. No.: 280,354
[22] Filed: Jul. 6, 1981
[30] Foreign Application Priority Data
Jul. 8, 1980 [FR] France ..... 80 15158
[51] Int. Cl.[3] ..... H04R 29/00
[52] U.S. Cl. ..... 367/13; 73/1 DV
[58] Field of Search ..... 367/13; 179/175.1 A; 73/1 DV, 801; 340/515

[56] References Cited
U.S. PATENT DOCUMENTS
4,043,175 8/1977 Fredriksson et al. ..... 367/13
4,296,483 10/1981 Haill ..... 367/13
FOREIGN PATENT DOCUMENTS
628962 10/1978 U.S.S.R. ..... 367/13

*Primary Examiner*—Richard A. Farley
*Attorney, Agent, or Firm*—Cushman, Darby & Cushman

[57] ABSTRACT
In an industial installation which is inaccessible during operation, acoustic-emission testing of each measurement line is performed by means of at least one transducer and a preamplifier which is connected to an acoustic signal processing unit by means of a signal transmission line and a supply line. A potentiometer circuit placed on the supply line produces a variation in the supply voltage and remotely operates a relay for switching the measurement line to testing means comprising a local pulse generator connected between the transducer and the preamplifier.

20 Claims, 4 Drawing Figures

REMOTE ACOUSTIC MONITORING DEVICE WHICH IS TESTABLE BY VARIATION OF THE SUPPLY VOLTAGE

This invention relates to a remote acoustic monitoring device which can be tested by means of a variation of the supply voltage. The invention is more particularly concerned with the field of surveillance by acoustic emission in industrial installations to which access cannot be gained during operation.

There are at least two reasons for inaccessibility. In the first place, there are some types of installation which do not permit access during operation (e.g. nuclear reactors, cracking towers, blast furnaces used in steelworks). The problem also arises in installations which are located at considerable distances from the data acquisition and monitoring station.

It has proved necessary, however, to direct efforts to the successful accomplishment of the following aims:

(a) monitoring of incipient crack formation (nuclear reactors) or accidental displacements of solid portions in piping systems (turbines), and so on;

(b) testing of the state of measuring units at regular intervals while monitoring is in progress.

The so-called acoustic emission techniques are adopted for the surveillance of structures. The appearance of a defect is a random event and constitutes an acoustic source. The measuring devices are therefore constituted by piezoelectric transducers which emit electrical signals in response to the acoustic waves. The electrical signals are transmitted via lines to units for processing operations such as location, discrimination, and so on.

The measuring devices are often subjected to high stresses which therefore make it necessary to test the state of such devices. The characteristics to be tested are as follows:

coupling of the transducer with the medium to be monitored;

calibration of transit times as required by calibrations of the processing units;

checking of the measurement line.

Devices of the prior art are attended by a certain number of disadvantages which are overcome by the invention.

In fact, devices of the type known heretofore comprise a transducer which is specific to the test operations and has the design function of an acoustic emitter which is coupled to the installation under surveillance. When the transducer is activated, it simulates an acoustic source accident and the responses of the different transducers are analyzed. The disadvantage of this test device lies firstly in the fact that it increases the number of acoustic elements and therefore the number of control elements and lines. Furthermore, the acoustic emitter is subjected to the same stresses as the transducers and may therefor have the same defects as the transducers which are intended to be tested by said emitter.

According to the invention, provision is made in a remote acoustic monitoring device for at least one measurement line comprising a detector connected at a short distance to a preamplifier which is connected at a substantial distance to a signal-processing unit by means of a two-lead line, one lead being reserved for the signals to be processed and the other lead being reserved for the supply of current to the measurement line. The device is essentially provided in addition with means which serve to vary the supply voltage and carry out remote triggering of the means for switching the measurement line to testing means.

Other features of the invention will be more apparent upon consideration of the following description of different embodiments, reference being had to the accompanying drawings, wherein.

Figure 1:
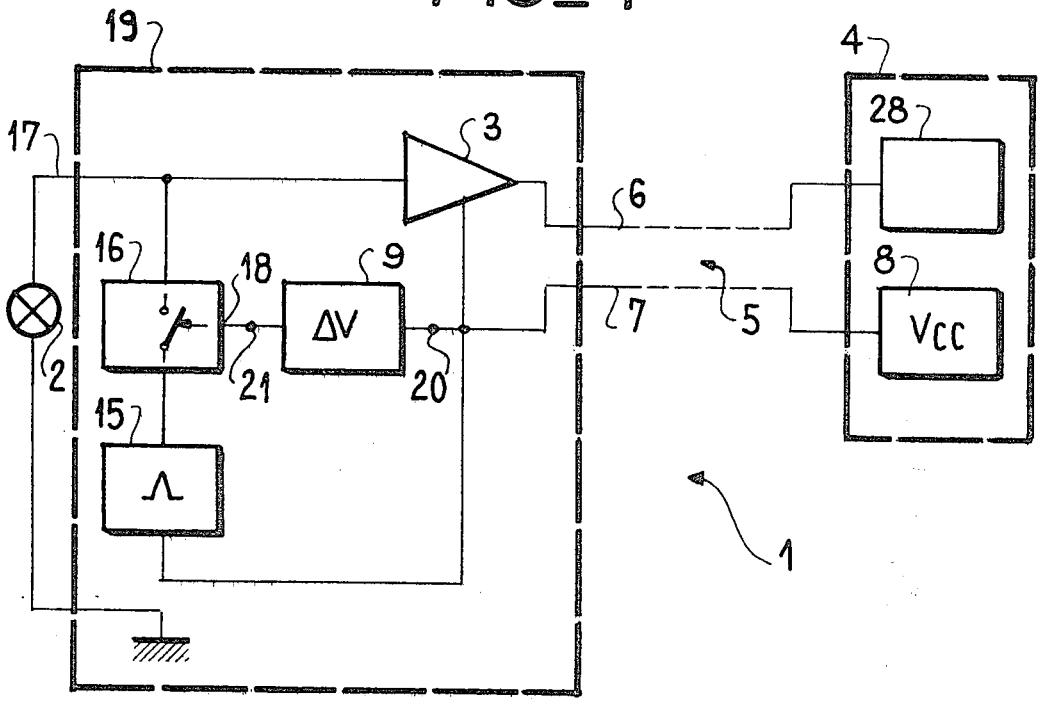
FIG. 1 is a diagram showing one of the measurement lines of a monitoring device according to the invention.

There is illustrated in FIG. 1 a measurement line 1 of the monitoring device according to the invention. The device comprises a transducer 2 which is coupled to the structure under surveillance and this latter is connected to an assembly which is placed within a casing 19. Said casing is placed at a short distance from the transducer 2 and connected electrically to this latter by means of a two-lead line 17. The first lead is connected to the ground frame of the casing 19 and the second lead is connected to an amplifier 3 contained within the casing 19. The signals collected by said transducer are transmitted via said amplifier to the processing unit 4 by means of a lead 6 of the connecting line 5. The supply of direct current Vcc to the casing 19 is effected by means of a lead 7 of the line 5.

At the level of the processing unit 4 and therefore at a distance from the structure monitored by the transducer 2, provision is made for a device 8 which serves to produce a variation in the supply voltage. By way of example, said device 8 can comprise a potentiometer circuit placed at the output of the regulated supply which distributes the direct-current supply voltage Vcc to all the components of the measurement lines. The variation in voltage can be initiated by an operator or by means of a program if the acquisition of data by the processing unit is controlled by computer.

The amplitude of variation in supply voltage Vcc is such that the preamplifier 3 is not sensitive to said variation but is picked-up a voltage-variation detector 9, the input 20 of which is connected to the lead 7 of the direct-current supply Vcc. The output 21 of the detector 9 is connected to the control terminal 18 of a switching relay 16. Said switching relay 16 is connected to the output of a local pulse generator 15 which is supplied with direct-current voltage from the lead 7, for example. Said generator 15 delivers a sequence of test pulses on the measurement line 1. When the switching relay 16 is closed, said pulses are sent on the one hand to the transducer 2 and on the other hand to the preamplifier 3.

Two pulse trains therefore reach the processing unit 4. A first train of so-called direct pulses is composed of pulses delivered by the local generator 15 and amplified by the preamplifier 3. A second train of so-called indirect pulses is composed of electrical pulses which constitute the response of the transducer 2 to different acoustic waves.

Figure 2:
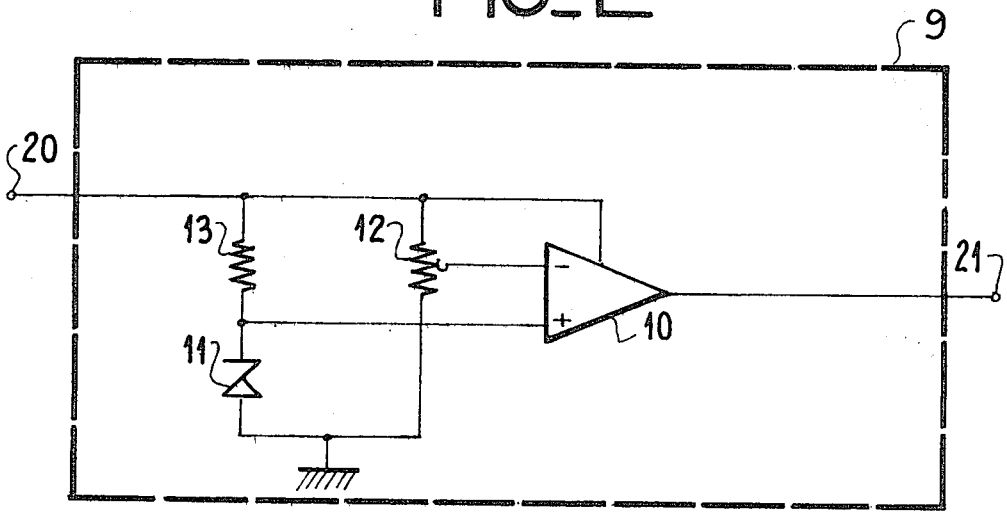
FIG. 2 is a diagram showing a detail of FIG. 1.

One particular example of construction of a detector 9 for detecting a variation in supply voltage Vcc is shown in FIG. 2. Starting from the input 20, a detector 9 of this type comprises a line for supplying an operational amplifier 10 which is insensitive to the selected test variation. A resistor 13 for biasing a Zener diode 11 makes it possible to obtain a fixed voltage which is applied to one of the terminals of the amplifier 10. A fraction of the supply volage Vcc taken from the supply lead by the potentiometer 12 is applied to the other input terminal of the amplifier 10. A comparison of these two voltages is such that a voltage drop in the lead 7 which has no effect on the supply of the amplifier 10 is compared with the reference voltage delivered by the diode 11. A comparison signal is obtained at the output terminal 21.

The aforesaid comparison signal which is applied to the control terminal 18 of the switching relay 16 serves to close the contact. The local pulse generator 15 then delivers on the measurement line 1. When the potentiometer 8 is connected in its neutral position, the supply voltage returns to its nominal value. A fresh signal appears at the output terminal 21 of the detector 9 and reopens the contact of the switching relay 16. The measurement line 1 is then ready to operate.

Figure 3:
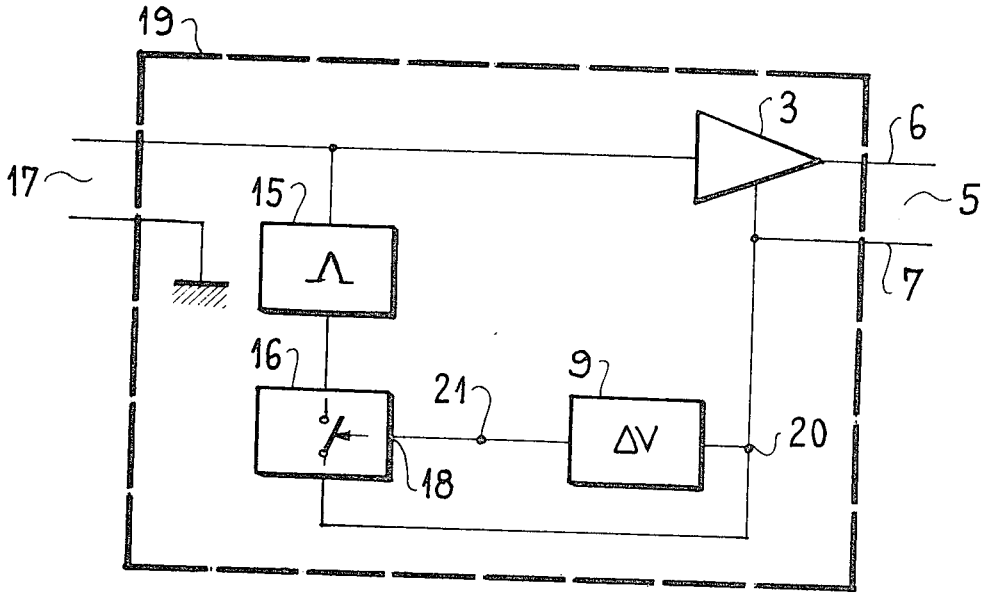
FIG. 3 is a diagram showing an alternative embodiment of a detail of FIG. 1.

In FIG. 3, there is shown another arrangement of the casing 19. The switching relay 16 is placed on the supply-line lead 7 of the local pulse generator 15. This arrangement makes it possible to initiate operation of the generator 15 only at the moment of testing.

Figure 4:
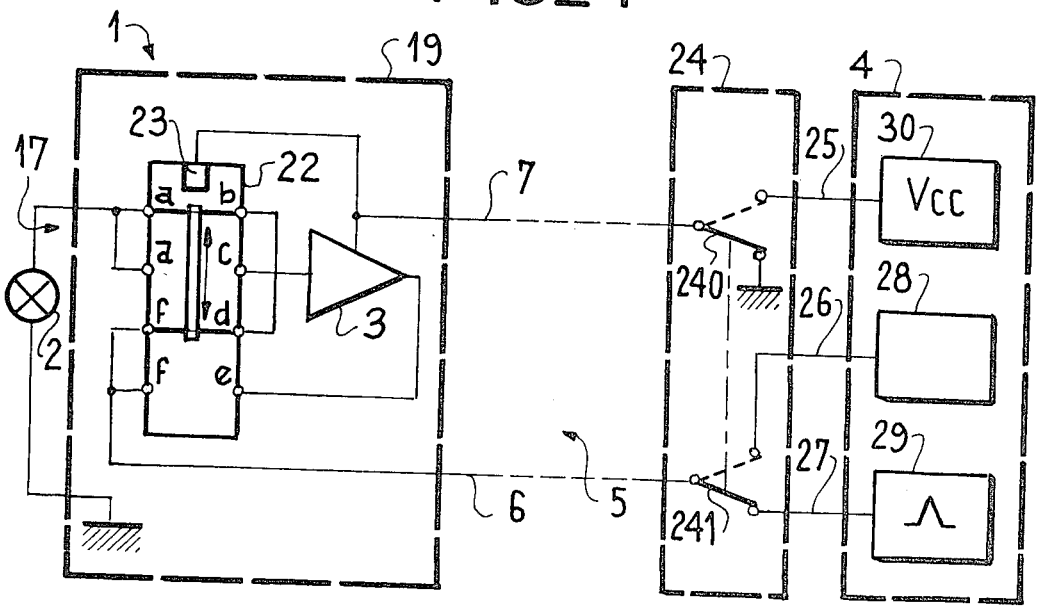
FIG. 4 is a diagram showing one of the measurement lines of another embodiment of the monitoring device according to the invention.

There is shown in FIG. 4 a simplified alternative embodiment of the device according to the invention. The variation in voltage is a voltage nullification by interruption of the supply Vcc. The measurement line 1 is again constituted by the same basic elements, namely a transducer 2, a casing 19 located in the proximity of said transducer, a connecting line 5 with a signal lead 6 and a supply lead 7, and a signal-processing unit 4. The casing 19 is also provided with a preamplifier 3.

The voltage nullification mentioned in the foregoing is carried out by means of two switches 22 and 24. The switch 24 has two contacts 240 and 241 which are coupled together mechanically so as to ensure simultaneous switching.

The switch 22 has eight terminals a, a, b, c, d, e, f, f, is provided with a double-pole sliding contact which establishes the following connections simultaneously: a-b and f-d or a-c and f-e. The transducer 2 is connected to the two terminals designated by the reference a which are in turn connected to each other and the signal lead 6 is connected to the two terminals designated by the reference f. A lead-wire connects the two terminals designated by the references b and d the terminal c is connected to the input of the preamplifier 3 and the terminal e is connected to the output of this latter.

In the position (a-b, f-d) shown in FIG. 4 or so-called test position, it is noted that the transducer 2 is connected directly to the lead 6 of the connecting line 5. In the second position or so-called measurement position, all the elements of the measurement line 1, namely the transducer 2, the preamplifier 3, the connecting line 5, are connected to the processing unit 4. Signal transmission between the switch 24 and the data-acquisition portion 28 of the unit 4 takes place via the connection 26. The regulated supply 30 then delivers the voltage Vcc to the lead 7 via the connection 25.

When the operator desires to carry out a test on the measurement line 1, he accordingly actuates the switch 24. The contact 240 changes over to ground (as shown in FIG. 4). The supply Vcc to the casing 19 is interrupted. By means of the terminal 23, voltage cutoff on the lead 7 serves to initiate a changeover of the switch 22 to the test position: a-b and f-d.

The switch 22 is provided with a device 23 for controlling its sliding contact. Said control device 23 can be composed for example of a two-position relay. The first position is obtained by direct-current supply to the relay. The second position can be obtained by interrupting the current supply, provision being made for a spring (not shown in FIG. 4) which restores the sliding contact to said second position.

The contact 241, the movement of which is related to that of the contact 240 changes over, thus connecting the signal lead 6 to the connection 27 in order to connect a testing pulse generator 29 to the measurement line 1.

The test then takes place as described earlier. All the operations involved in the two devices hereinabove described can be program-controlled. In particular in the case of a central processing unit 4 which receives data from a large number of measurement lines each equipped with a remote control device in accordance with the invention, the number of test signals to be processed may be considerable.

The test system described in the foregoing finds an application both in the field of acoustic emission and in the field of ultrasonic inspection. In fact, the transducer 2 which is excited by the pulse generator 15 emits acoustic waves and a fraction of these latter is reflected by variations in acoustic impedance, or in other words reflected from obstacles, and returned to the transducer 2. Said transducer transmits to the processing system 4 a train of indirect pulses including echos, which is very often the case with ultrasonic waves.

When using acoustic emission, the test section of the transducer 2 proves effective, especially when a number of measurement lines are provided with remote testing devices which are independent of each other. In fact, a part of the acoustic waves emitted by each line transducer such as the transducer 2 is received by this latter and converted to electrical pulses which also constitute the second train of so-called indirect pulses.

A number of different arrangements can be made in the present invention. Thus the various frame grounds described in the foregoing can be connected to the ground of the processing system 4.

The preamplifier 3 can be made insensitive to the variation in voltage by means of a regulating device. A typical example of application consists in providing the +12 volt supply input of the preamplifier 3 with a regulator, the input of which is connected to the supply lead 7 and the value Vcc varies within the range of 30 20 V to +15 V, for example.

What is claimed is:

1. A remote acoustic monitoring device comprising:

a transducer, capable of emitting and receiving, for providing surveillance of a predetermined area;

an amplifier, coupled to said transducer, for amplifying a signal therefrom;

a data acquisition unit, coupled to said amplifier, for processing a signal therefrom;

means for providing a supply voltage to said amplifier that is controllably variable;

testing means, coupled to said supply voltage means, and responsive to a voltage variation thereof, for providing a test signal to said transducer and to said amplifier simultaneously, whereby the data acquisition unit can determine the response of said transducer to said test signal by comparing a signal from said amplifier responsive to the test signal applied directly thereto from said testing means with a signal from said transducer responsive to the test signal applied to said transducer.

2. A device according to claim 1, wherein the supply voltage means comprises a potentiometer on a supply line, said potentiometer being incorporated in the signal processing device.

3. A device according to claim 2, wherein said testing means comprises a detector for detecting a variation in the supply voltage to the amplifier and wherein the potentiometer produces a variation in voltage to which said amplifier is insensitive.

4. A device according to claim 3, wherein the voltage variation detector comprises a comparator circuit for comparing the supply voltage with a reference voltage.

5. A device according to claim 4, wherein the comparator circuit comprises an operational amplifier and the reference voltage is provided by a Zener diode biased by a resistor and a second potentiometer having substantially higher value than that of the resistor and wherein said comparator circuit compares a fraction of the supply voltage taken from the second potentiometer with the reference voltage delivered by said Zener diode.

6. A device according to claim 1, wherein the testing means comprises a local pulse generator for generating said testing signal.

7. A device according to claim 3, wherein the testing means for switching the measurement line to the testing means further comprises a local pulse generator for generating said testing signal and switching means responsive to said voltage variation detector for selectively coupling the test signal to said transducer and to said amplifier, said switching means comprising a switching relay operated by a control terminal thereof which is connected to an output of the voltage variation detector.

8. A device according to claim 7 further comprising a casing which provides isolation from external influences for the amplifier, the voltage variation detector, the local pulse generator and the switching relay, said transducer being placed in proximity to said casing.

9. A device according to claim 8, wherein an output of the local pulse generator is connected through the switching relay between the transducer and the amplifier.

10. A device according to claim 9, wherein the switching relay is placed on a branch line which bypasses a line from said supply voltage means and is connected to an input of the local pulse generator.

11. A device according to claim 9, wherein the switching relay is connected to an output of the local pulse generator and to a connecting line between the transducer and the amplifier.

12. A device according to claim 1, wherein the supply voltage means comprises switching means and for switching a measurement line to a test position.

13. A device according to claim 12, wherein the switching means comprise:

a first switch located in proximity to a processing unit containing said data acquisition unit and said supply voltage means, said switch being adapted in one position thereof to place a connecting line between said processing unit and a casing containing said amplifier in the measurement position and in another position thereof to place said connecting line in the test position, a second switch located in proximity to the transducer, said second switch being adapted in the measurement position of the first switch to place the amplifier in the measurement line and in the test position to replace said first switch by a short-circuit, and wherein said second switch is controlled from its terminal by interruption of the supply produced by the second switch on the aforementioned signal transmission lead.

14. A device according to claim 13, wherein the first switch is actuated by an operator and wherein said switch is provided with two contact arms coupled together, the first contact arm being adapted to couple the supply line to a lead providing a connection with a regulated supply or to ground, the second contact arm being adapted to couple the signal transmission lead either to a lead providing a connection with a signal acquisition device of the processing unit or alternatively to a lead providing a connection with a testing pulse generator.

15. A remote acoustic monitoring device according to claim 1 further comprising a first casing containing said amplifier, and testing means, said transducer being coupled to said first casing and amplifier via a two-lead line.

16. A remote acoustic monitoring device according to claim 15 further comprising a processing unit casing containing said data acquisition unit and said supply voltage means.

17. A remote acoustic monitoring device according to claim 1 wherein said testing means comprises: a local pulse generator for generating said test signal, voltage variation detector means for detecting a variation of supply voltage, and a gate, operable by said voltage variation detecting means for selectively coupling the test signal from the local pulse generator to both the transducer and the amplifier.

18. A remote acoustic monitoring device according to claim 17 further comprising a first casing enclosing said amplifier, voltage variation detector means, local pulse generator and gate, said transduer being placed outside of said casing.

19. A remote acoustic monitoring device according to claim 1 wherein said testing means comprises: voltage variation detector means for detecting a variation of supply voltage, a local pulse generator for generating said testing signal when a voltage is applied thereto, said local pulse generator having a test signal output coupled to said transducer and to said amplifier, and a gate, operable by said voltage variation detector means for selectively applying a voltage to said local pulse generator.

20. A remote acoustic monitoring device, comprising:

a transducer, capable of emitting and receiving, for providing surveillance of a predetermined area;

an amplifier for amplifying signals from said transducer;

a supply voltage source;

a data acquisition unit for processing signals from said amplifier;

a test signal generator;

a first line;

a second line;

a voltage nullification switch operable in a first position to connect said first line to said supply voltage source and said second line to said data acquisition unit and in a second position to connect said first line to a circuit ground and said second line to said test signal generator; and switch means, interconnecting said second line with said amplifier and transducer, operable in a test or measurement position, said switch means being in said measurement position with said voltage nullification switch being in said first position causing said transducer to couple to signal to said amplifier and a signal from said data acquisition unit, and said switch means being in said measurement position with said voltage nullification switch being in said second position causing voltage from said supply source to be temporarily removed from said amplifier and a test signal from said test signal generator applied to said transducer and amplifier.

* * * * *